United States Patent [19]

Palle et al.

[11] 4,226,495

[45] Oct. 7, 1980

[54] CABLE SYSTEM SUBSCRIBER TAP WITH ROTATING CENTER CONDUCTOR SEIZURE APPARATUS AND SPIRAL CONTACT AND METHOD FOR USING SAME

[75] Inventors: Robert J. Palle, Phoenix; Sidney R. Smith, Glendale; Kenton D. Rockwell, Phoenix; Charles F. Napierski, Sun City, all of Ariz.

[73] Assignee: Texscan Corporation, Indianapolis, Ind.

[21] Appl. No.: 34,465

[22] Filed: Apr. 27, 1979

[51] Int. Cl.[3] ..... H01R 9/10; H01R 17/04

[52] U.S. Cl. ..... 339/122 R; 339/177 R; 339/272 A

[58] Field of Search ..... 339/17 C, 122 R, 177 R, 339/177 E, 272 R, 272 A

[56] References Cited

U.S. PATENT DOCUMENTS

| | | | |
|---|---|---|---|
| 3,530,425 | 9/1970 | Vachhani | 339/177 |
| 3,675,181 | 7/1972 | Lankford et al. | 339/177 R |
| 3,778,535 | 12/1973 | Forney, Jr. | 339/177 R |
| 3,847,463 | 11/1974 | Hayward et al. | 339/177 R |
| 3,951,490 | 4/1976 | Devendorf | 339/17 C |
| 3,989,333 | 11/1976 | Cauldwell | 339/17 C |
| 4,025,150 | 5/1977 | Nordberg et al. | 339/177 R |

*Primary Examiner*—Neil Abrams

*Attorney, Agent, or Firm*—Woodard, Weikart, Emhardt & Naughton

[57] ABSTRACT

A cable system subscriber tap equipped with a rotating center conductor seizure apparatus for mechanically and electrically seizing the center conductor of a coaxial cable. The improved seizure apparatus provides a rotating clamp held within an insulating structure mounted in the tap adjacent each of the orthogonally arranged pairs of cable access ports, the seizure clamp being rotatable between orthogonal positions within its insulating structure to alternately seize the center conductor of a coaxial cable inserted through either one of the pair of access ports without diassembly of the clamp or seizure apparatus. The improved clamp provides a nonshear seizure of the center conductor that is both quickly and easily changed in the field. It further includes a conductive, spiral spring contact held within a countersunk axial bore in the clamp and rotatable therewith while maintaining mechanical and electrical connection to the contact pin of a printed circuit board. Improved methods for installing and for changing cable installations are also disclosed using the same.

43 Claims, 7 Drawing Figures

CABLE SYSTEM SUBSCRIBER TAP WITH ROTATING CENTER CONDUCTOR SEIZURE APPARATUS AND SPIRAL CONTACT AND METHOD FOR USING SAME

BACKGROUND OF THE INVENTION

This invention relates generally to the field of electrical cable connecting apparata. More specifically, it relates to a center conductor seizure apparatus of particular use in a community antenna television transmission system, often referred to as a CATV system.

In communication systems in general, coaxial cables are almost exclusively used for handling the radio and ultra-high frequency wave energies necessarily encountered. Such cables typically include elongate center and outer conductors having a common axis and separated by a dielectric medium which can be air, or a synthetic such as polyethylene foam. The center conductor carries the high frequency signal and is of single or multi-strand wire design, being made of copper, copper-plated aluminum, or some other plated conductive metal. The outer conductor is of tubular design, is aluminum or some other alloyed conductive metal, and serves to shield the center conductor from external forces that may interfere with signal transference, as well as to provide an electrical ground for the system. The dielectric spacer material holds the two conductors in coaxial alignment and also helps to insulate the center conductor from corrosive elements.

These coaxial cables have proved highly effective in handling the frequencies experienced with CATV systems. However, problems have arisen in the design and construction of suitable connecting means for intermediate and terminal connecting with such cable lines.

As the name implies, a CATV system contemplates the use of a central antenna situated as to best receive a number of differing television signals emanating from various sources. The antenna is usually remote from the ultimate consumers, and the signals must therefore be transmitted to the television sets of the individual subscribers by means of coaxial cables connected through a series of intermediate devices. Such devices include signal amplifiers, line splitters, direction couplers, and other active and passive devices which are interposed at various points in a given cable to direct signals along various secondary transmission paths. It is the mechanical and electrical connection at these various points that has caused continual problems for the CATV systems.

Another of these intermediate devices is a subscriber tap, also known as a tap connector box, a multi-tap, a cable substation, a directional device and the like. Regardless of its name, this tap forms the interface between the cable system and the ultimate customer. In particular, there exist secondary, or "feeder", cables which branch from a primary, or "trunk," line to service smaller residential areas by transmitting signals to these subscriber taps. Each tap in turn connects into the signal path and carries the signal directly to the television sets of a small number of individual subscribers.

These subscriber taps generally include a box-like, conductive housing having a removable base and a pair of coaxial cable access ports orthogonally positioned at each of two corners on the housing structure to signify the signal input and output sides of the housing. These alternative input and output ports attest to the two common methods of CATV installation. First is an aerial installation in which the housing is typically suspended from a metal strand with cable access being through opposite sides of the housing to minimize bending of the coaxial cable. Second is an above- or below-ground installation in which a pedestal mounting is used with cable access generally on the same side of the housing for convenience. An "L" installation is also possible with the pairs of orthogonal ports; but regardless of the particular installation used, the unused ports are generally plugged or capped to maintain the integrity of the inner housing chamber.

Electrical circuitry is then provided in the housing connecting to the seized center conductors and transmitting the signal to a number of individual subscribers through subscriber connectors and cables attached to the base cover of the subscriber tap.

Two problems of mechanical and electrical connection are encountered with these subscriber taps.

First, some form of cable connectors means must be used to mechanically and electrically connect the outer cable conductor with the housing at its point of entry through an access port. Such connector means are known in the art. For example, Forney, Jr., U.S. Pat. No. 3,778,535, issued Dec. 11, 1973, discloses a coaxial connector designed to avoid collapsing the outer cable conductor while not altering the characteristic impedance of the coaxial cable, determined as a function of its inner dimensions, thereby avoiding any reflective loss in the frequency signal being transmitted. Hayward et al., U.S. Pat. No. 3,847,463, issued Nov. 12, 1974, discloses a related connector apparatus designed to withstand the various rotational and vibrational forces experienced by the cable through wind and otherwise without the eventual fatigue and rupture experienced with other connectors.

The second area of contact involves the mechanical and electrical seizure of the center cable conductor within the housing chamber. This seizure is typically accomplished by the use of a screw means clamping the center conductor is a connector device after its insertion through one of the access ports. Problems are also common with these connectors.

For example, Lankford et al., U.S. Pat. No. 3,675,181, issued July 4, 1972, discloses a connector claiming an improved seal means and supposed to avoid the normal conductor loosening encountered with prior art devices as a consequence of a metallurgical phenomenon known as "cold flow." Other related connecting devices have concentrated on the problems of shearing and other damage to the center conductor caused by cross screw connectors, such as Cauldwell, U.S. Pat. No. 3,989,333, issued Nov. 2, 1976, and Nordberg et al., U.S. Pat. No. 4,025,150, issued May 24, 1977.

Still two further connector apparatus are shown in Vachhani, U.S. Pat. No. 3,530,425, issued Sept. 22, 1977, and Devendorf, U.S. Pat. No. 3,951,490, issued Apr. 20, 1976. Vachhani securely holds the center conductors of connecting cables between the serrated contacts of its pressure terminals. Devendorf, on the other hand, discloses a substation seizure apparatus secured to the housing by a plurality of standing projections claimed to distribute the forces exerted by the center conductor throughout the assembly frame.

Still further problems exist unresolved by the subscriber taps known to date.

For example, the majority of seizure mechanisms now marketed continue to permit the shear of center conductors during installation. To provide for alternatively using the holes in the seizure device for both the seizure screw and the center conductor, these manufacturers drill their devices completely through from both the pedestal and aerial directions, tapping each hole to alternately accommodate either the screw or the center conductor. Therefore, when the seizure screw is tightened down against the center conductor, directly behind the center conductor is a hole causing the clamp to act like a punch and die set with respect to the conductor wire. If tightened too far, the screw will shear the center conductor by pushing it into the hole. Even if not severed, the conductor is often sufficiently damaged by pressing against either the back opening or the cutting threads of the tapped hole to fail under temperature cycles as the various expansion and contraction forces are exerted by temperature changes in the cable system.

Another problem concerns material selection. For instance, tin-plated brass connectors are known for long-term durability and are used in all terminators, drop connectors and expensive addressable taps used in the CATV industry. However, some manufacturers use aluminum spigots which under atmospheric conditions form a highly corrosive galvanic cell interface with a tin-plated brass contact thereby becoming welded, stuck, or corroded together.

A still further problem involves the basic understanding of an ideal subscriber tap assembly. It must provide a lasting mechanical and electrical connection with the center conductor. It must provide an impedance match with the coaxial line to minimize signal loss or ghosting due to signal reflections. It must be impervious to weather conditions and provide a connection as strong as the cable itself. Finally, it must be capable of installation and change quickly and easily in the field under all anticipated conditions.

This last concern for the speed and ease of tap installation and change is of great importance. The majority of taps on the market provide for tightening the seizure screw through the unused orthogonal access port in the housing corner. To change from aerial to pedestal mounting, or vice versa, requires the installer to completely remove the seizure screw, insert the center conductor through the new access port, and then reinsert the screw through the alternate port in order to secure the proper connection. This operation is burdensome and time consuming to the installer. It also promotes conductor shear because the conductor is pressed against the serrated threads on the inside wall of either seizure bore while further being pressed into the back opening.

The only subscriber taps on the market not using this disassembly procedure provide for vertical seizure of the center conductor by placing two separate access ports for the seizure screws in the housing wall opposite the base or the base itself. Center conductor seizure through alternate ports then does not require complete removal and reinsertion of the seizure screw. It does, however, require manipulation of another pair of access ports and caps. In addition, one such manufacturer bores completely through its clamp in the vertical direction thereby providing the same shearing problem during use.

This requirement of speed and ease in subscriber tap installation or change also concerns the accessibility of the inner housing chamber for repair of replacement of the seizure mechanism or the printed circuitry used to connect to the cable center conductor. In this regard, complex disassembly procedures must be avoided so that repair or replacement of internal parts can be accomplished quickly and easily in the field.

SUMMARY OF THE INVENTION

Various aspects of this invention comprise an improved subscriber tap and seizure apparatus eliminating the problem of conductor shear while providing means for alternately seizing the center conductors of coaxial cables of differing orientation to the seizure apparatus. This means is by simple rotation of a seizure clamp and screw within an insulated structure and without the need for any disassembly thereof. A third aspect comprises an improved method for using the same having corresponding advantages over existing prior art methods.

In one embodiment, an improved rod-like seizure clamp has a first radial bore therethrough and a second partial radial bore threaded to receive a seizure screw and terminating upon intersection with this first bore. The clamp is rotatably held within an insulating structure having orthogonal openings to the clamp and alternately alignable with the first and second bores therein. A channel cut in the insulating structure joins these openings to permit orthogonal rotation of the clamp without disassembly of the seizure screw, thus providing for quick and easy installation or change in the field. An axial bore in the clamp and mating opening in the structure accompany means, including a spiral spring contact, for electrically connecting the clamp and seized center conductor with appropriate electrical circuitry means in the housing for distribution of the signal to individual subscribers.

Related objects and advantages of the present invention will be apparent from the following description.

DESCRIPTION OF THE PREFERRED EMBODIMENTS

Figure 1:
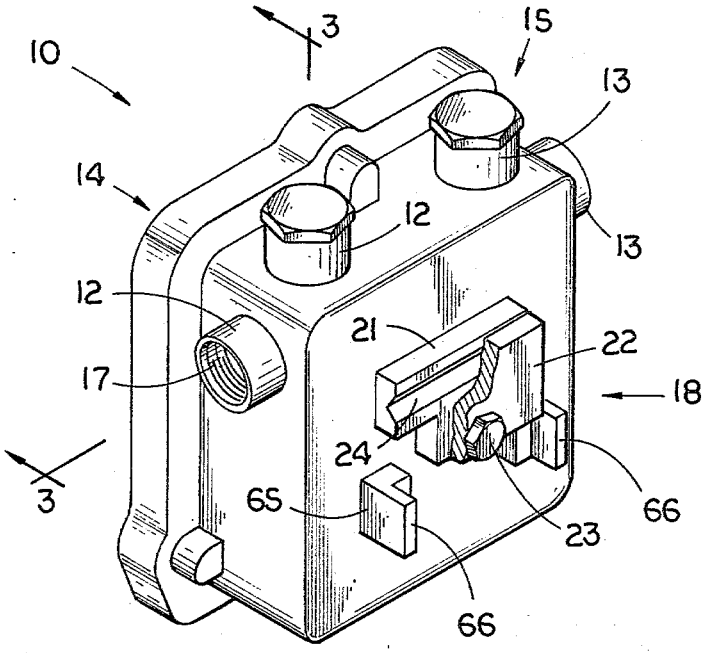
FIG. 1 is a perspective view of th subscriber tap of the preferred embodiment incorporating applicant's improved center conductor seizure apparatus.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated devices, and such further applications of the principles of the invention as illustrated therein being contemplated as would normally occur to one skilled in the art to which the invention relates.

Describing first the preferred apparatus of applicant's invention, it generally comprises a cable system subscriber tap incorporating applicant's improved rotating center conductor seizure apparatus. In FIG. 1 there is depicted applicant's preferred tap 10 which includes a conductive housing 11 having two pairs of coaxial cable access ports 12 and 13 orthogonally positioned adjacent two corners 14 and 15 of the housing body. These ports 12 and 13 correspond respectively to the signal input and signal output path orientations through the subscriber tap. The ports are internally threaded to aid in establishing an effective mechanical and electrical connection with the outer conductor of a coaxial cable which has been prepared in accordance with known procedures. By "prepared cable," it is meant that the outer cable conductor and dielectric medium have been removed from an area adjacent the cable end to expose a portion of the center conductor for insertion and seizure inside the inner housing chamber 16. To maintain proper shielding and provide a strong connection with the subscriber tap, the prepared cable is also connected to some known connecting means which provides a male portion for connection with the internal threading 17 of the access port. Two examples of such known cable connecting means are disclosed in the Forney, Jr. and Hayward et al. references described above.

In field use, coaxial cables carrying the transmitted signal are alternately connected to the orthogonally arranged pairs of access ports in accordance with the particular installation required. For example, in aerial installation it is desirable to employ the two opposing ports 12 and 13 in order to minimize the required angular deflection of the center conductor inside the tap. With pedestal mounting either above or below ground level, however, interests of space and convenience often require use of the side-by-side ports 12 and 13 on the same side of the housing body. With this orthogonal orientation, it is further possible that a "L" cable connection could be used if the circumstances so require. In any case, the initial tap installation is accomplished by means of a bracket structure 18 including a raised portion 21, a plate 22, and a fastening screw 23. A groove 24 is formed in this raised portion and the bracket structure is readily attachable to any cable or strand (not shown) for either aerial, pedestal or "L" installation.

Figure 2:
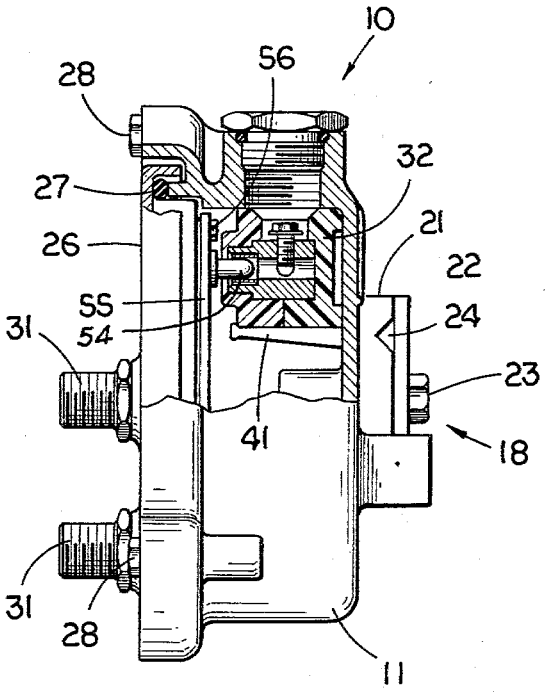
FIG. 2 is a part-sectional end view of the tap in FIG. 1.
Figure 4:
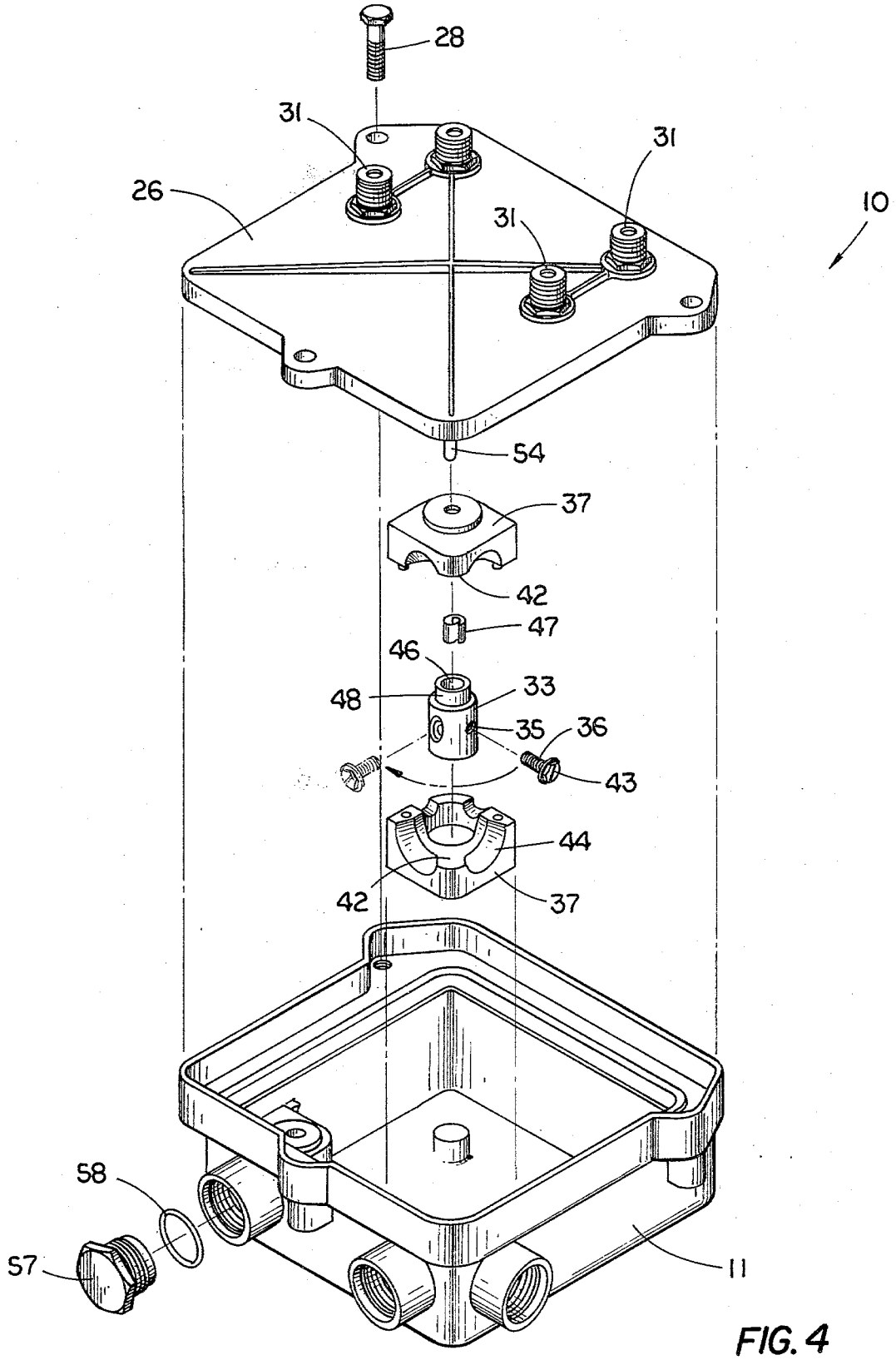
FIG. 4 is an exploded view of the tap in FIG. 1.
Figure 5:
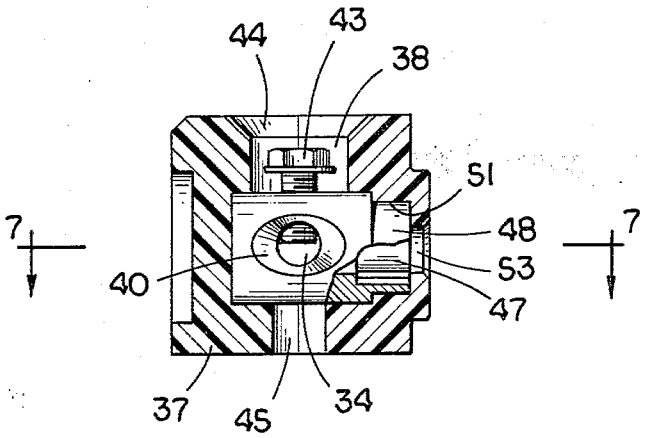
FIG. 5 is an enlarged part-sectional view of applicant's improved center conductor seizure apparatus taken along line 5—5 in FIG. 3.

Referring now to the sectioned view in FIG. 2, preferred tap 10 also includes a conductive base cover 26 detachably secured to the housing by fastening means including an O-ring weatherproof seal 27 and three screws 28 (better shown in FIG. 4). Subscriber connectors 31 on the back of cover 26 then transmit the signal received from the center cable conductor to the television sets of individual subscribers of the particular CATV system.

This subscriber transmission first requires both an effective mechanical and electrical seizure of the center conductor after its insertion through an input port 12 and a proper mechanical and electrical connection of the outer conductor with housing 11. This center conductor seizing means in preferred tap 10 is accomplished by use of applicant's improved seizure apparatus, or mechanism, generally designated by numeral 32 in FIG. 2.

In applicant's improved center conductor seizing means, seizure apparatus 32 first includes a rod-like, conductive seizure clamp 33 having a first radial bore 34 extending at least part way therethrough and a second radial bore 35 tapped and intersecting the first bore. A seizure screw 36 is threaded to mate with this second bore and to secure the center conductor of a coaxial cable inserted in first bore 34. Clamp 33 is rotatably held within a supportive, insulating structure 37 which has a plurality of outer openings to the clamp and its first and second bores. Means are then provided for alternately seizing, with this clamp 33, center conductors of differing orientation to insulating structure 37 by simple rotation of the clamp therein and without any disassembly thereof.

Figure 3:
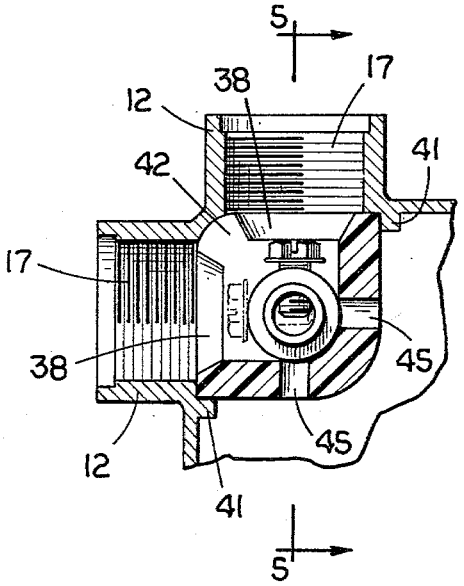
FIG. 3 is an enlarged part-sectional view of one corner of the tap taken along line 3—3 in FIG. 1 and exposing the internal features of applicant's improved seizure apparatus.
Figure 7:
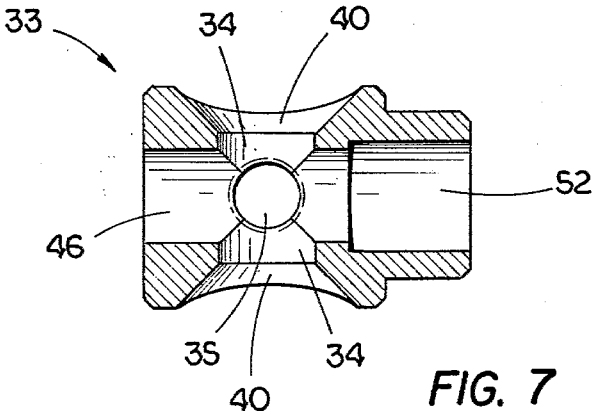
FIG. 7 is an enlarged sectional view of applicant's preferred clamp taken along line 7—7 in FIG. 5.

In the preferred embodiment, applicant's improved seizing means is therefore usable interchangeably with either one of the orthogonal cable access ports through simple rotation of the clamp connector and without the need for disassembling and reassembling the screw attachment. This is accomplished in preferred tap 10 by extending first bore 24 through the clamp with second bore 35 located orthogonally thereto and terminating upon intersection with the first bore, as better seen in FIG. 7. Preferred insulating structure 37 is provided with a pair of openings 38 orthogonally arranged to alternately align with the first and second bores upon rotation of the seizure clamp therein. Retaining means including a pair of brackets 41 projecting from the inner walls of housing 11 secure the two seizure mechanisms 32 in the housing corners 14 and 15, respectively, with their openings 38 properly aligned with the corresponding orthogonal access ports (as better shown in FIGS. 3 and 4).

Insulating structure 37 in the preferred embodiment further includes a radial channel 42 joining its pair of orthogonal openings 38 to permit rotation of the seizure clamp between these openings without interference with or removal of the preferred seizure screw which has an enlarged head 43. Openings 38 and the opening ends of first bore 34 have a tapered surface 44 to simplify insertion of the center conductor of a prepared coaxial cable. Structure 37 includes to additional openings 45 opposite these tapered openings 38 to permit the inserted center conductor to pass completely through the structure during either aerial or pedestal installation of the subscriber tap.

Applicant's preferred seizure apparatus therefore provides a mechanical and electrical fitting that can be installed or changed quickly and easily in the field. There is no worry of disassembly because the change from aerial to pedestal installation, or vice versa, is accomplished by simply rotating the seizure clamp within its insulating structure and without disassembly or removal of the seizure screw. There is also no need to handle a third vertical access port and screw fastener, as with some prior art taps previously mentioned. Instead, applicant's seizure screw secures the center conductor of a cable inserted in either end of the first radial bore 34 depending upon the rotational alignment of the clamp and screw with respect to the orthogonal access ports, as better shown in FIG. 4.

Applicant's preferred seizure apparatus also eliminates any concern of shearing the center conductor during installation or through fatigue and rupture during use. Applicant's first bore has no serrated threads to cut into the center conductor during seizure. By terminating the second bore upon intersection, applicant provides a blind, or positive, stop without a back opening to shear the center conductor as is true with the majority of taps now marketed. In the preferred embodiment, applicant's seizure screw 36 is further of such a length as to be too short to contact the inner wall of the first bore opposite its intersection therewith. It is thus not possible for the screw to be tightened so far as to pinch off the center conductor, again as experienced with prior art devices.

The final aspect of applicant's subscriber tap 10 is the provision of means for electrically connecting the center conductor and seizure clamp with electrical circuitry means in the housing to transmit the television signal to the local subscribers. In the preferred embodiment, this means includes an axial bore 46 in one end of the clamp and a conductive spiral spring contact 47 received within this bore for connection with the electrical circuitry means in the housing. This end portion of the clamp 33 has a reduced outer diameter 48 mating with a correspondingly sized cavity, or recess, 51 in the insulating structure 37. The preferred axial bore 46 further extends through the clamp intersecting with the first and second radial bores, and has an enlarged countersunk portion 52 for positioning of the spiral contact therein.

Figure 6:
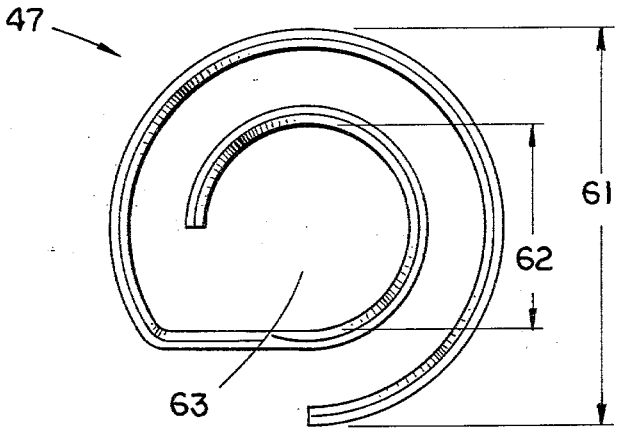
FIG. 6 is an enlarged end view of applicant's preferred spiral spring contact.

An opening 53 in the insulating structure exposes this contact 47 for insertion of a conductive contact pin 54 connected to a printed circuit board 55 which is attached to the base cover 26 by means of several fastening screws 56. This spiral spring contact 47 is highly complementary to applicant's rotating seizure clamp 33 by permitting continuous electrical contact between a seized center conductor and the contact pin 54 during rotation of the seizure clamp. This is first accomplished, as better seen in FIG. 6, by constructing the contact 47 such that its outer diameter 61, when relaxed, is greater than the inside diameter of counterbore 52 in the seizure clamp. The spring contact is thus held in compression against the inner wall of this counterbore when positioned therein to maintain good electrical connection with the clamp 33. Second, the inner diameter 62 of the spring contact is constructed smaller than the outer diameter of contact pin 54 as to also maintain an electrical connection with the contact pin even during rotation of the seizure clamp. In the preferred embodiment, contact 47 is further provided with an inner chamfer 64 surrounding the central opening 63 to help guide the insertion of pin 54 therein.

The preferred tap 10 then has either two or four subscriber connectors 31 electrically connected to this printed circuit board for transmitting the signal to the local subscribers. The electrical circuitry of this printed circuit board 55 and its connection with the subscriber connectors 31 are not shown in detail since the specified circuitry is of no inventive aspect to applicant's invention and can be arranged as any suitable circuit and connection presently known or developed in the future.

Material selection is not an essential feature of applicant's apparatus, but is important if a lasting mechanical and electrical connection is to be provided with only negligible leakage or interference with the transmitted signal. For this reason, it is preferred to use a tin-plated brass seizure clamp connector and a matching printed circuit contact pin. Applicant's preferred seizure screw is stainless steel and his contact spring is of tin-plated beryllium copper composition. The housing and cover are of cast 360 alloy aluminum with chromate conversion coating.

The preferred insulating structure of applicant's clamp holder is mating halves of a block-like polystyrene plastic material, although those skilled in the art will realize the structure could be simply molded into a single insulating member. As the dimensions of the insulating structure and the proximity of the center conductor to the housing walls are both a function directly related to the capacitance of the system, it is important to size the dielectric, insulating structure as to provide a impedance match to the cable so as to offer no abnormal resistance to the signal passage. This is known to those skilled in the art and can be handled accordingly.

To provide a sealed inner chamber impervious to weather elements, applicant's preferred tap also includes two caps, or plugs, 57 equipped with O-ring seals 58 to seal the access ports unused in a particular installation.

Describing now the method of applicant's invention, the improved method of establishing or changing a particular CATV subscriber installation is described hereinbelow in connection with applicant's preferred tap 10.

In an initial installation, after mounting the tap using its bracket structure 18, the installer must select either the opposing or side-by-side access ports 12 or 13 for his aerial or pedestal installation. Once selected, and the protective caps 57 removed, the coaxial cable (not shown) is properly prepared as described above including attachment of a cable connector means for mating with the internal threading 27 of the access ports. Seizure clamps 33 are then positioned with first bore 34 aligned with the selected port and second bore 35 and seizure screw 36 exposed through the unused port. The center conductor is inserted through the first bore and corresponding openings 38 and 53 in the insulating structure, and the screw is tightened against the center conductor through the unused port. The caps 57 are then placed on the unused ports, the base cover is refastened to the housing (if needed), and the prepared cables (also not shown) are connected with the subscriber connectors 31 on the back of base cover 26 for transmission to the local subscribers.

A lasting mechanical and electrical connection is thereby formed impervious to weather elements with proper impedance match and negligible leakage and with a strong, nonshear seizure of the center conductor.

Change of an single installation is accomplished by first removing the cap 57, releasing the seized center conductor, and disconnecting the outer conductor and connecting means from the access port being used. Seizure clamp 33 is then rotated without disassembly through a 90° angle within its insulating structure to align the second bore and screw with the alternate orthogonal port while also aligning the opposite end of first radial bore 34 with the port now desired for installation. The bared center conductor and connecting means are then connected with this new access port with the conductor extending through first bore 34 and corresponding openings 38 and 53. The seizure screw is tightened through the now unused port to seize the center conductor within the clamp, and the plug is attached to this unused port to once again seal the inner chamber from outside weather conditions.

In this way, applicant's improved method of changing a subscriber tap installation is accomplished with simple rotation of the seizure clamp within its insulating structure and without any disassembly and later reassembly thereof. The installer need not grapple with other external access ports and screws, and the changed fitting can be thus made quickly and easily in the field. Furthermore, the installer need not remove the cover and disconnect the printed circuit board from the seizure apparatus during the changeover because the spiral spring contact 47 permits rotation of the clamp while maintaining a strong mechanical and electrical connection with the contact pin 54.

A further feature of applicant's preferred embodiment concerns the preparation of a coaxial cable for connection to subscriber tap 10. In particular, when preparing the coaxial center conductor or connector stinger for entry into the tap, the first question to answer is how long must the center conductor be to permit proper seizure by the clamp 33. To resolve this problem, the preferred housing 11 of applicant's tap includes a pair of cast-in center conductor trim guides 65 positioned such that the outermost extensions 66 define the correct length for the bared center conductor to permit proper internal seizure within the tap. There is no guesswork or time wasted by the installer in trial and error attempts. Instead, he can simply hold the coaxial cable end up to the cut-off guides 65 and trim the cable to its proper length.

A still further feature of applicant's preferred method and tap is the ease with which base cover 26 is removed to provide access to inner housing chamber 16. The operation is completed by simply removing fastening screws 28 and pulling on the base cover with sufficient force to dislodge contact pins 54 from within their spiral spring contacts 47. The installer has then gained full access to the inner chamber to permit unhindered repair or replacement of the seizure apparata 32 or printed circuit board 55.

While the invention has been illustrated and described in detail in the drawings and foregoing description, the same is to be considered as illustrative and not restrictive in character, it being understood that only the preferred embodiments have been shown and described and that all changes and modifications that come within the spirit of the invention are desired to be protected.

I claim:

1. A seizure apparatus for mechanical and electrical connection to the center conductor of a coaxial cable comprising:

(a) a rod-like, conductive seizure clamp, said clamp including:
  (1) a first radial bore therein;
  (2) a second radial bore tapped and intersecting said first bore; and
(3) a threaded seizure screw mating with said second bore to secure the center conductor of a coaxial cable inserted in said first bore;
(b) a supportive, insulating structure with said clamp rotatably held therein, said structure including a plurality of openings to said clamp; and
(c) means for alternately seizing with said clamp center conductors of differing orientation to said structure by rotating said clamp to align with different ones of said openings in said structure and without disassembly thereof or removal of said seizure screw from said clamp.

2. The apparatus of claim 1 in which said first bore extends through said clamp, said second bore being orthogonal thereto.

3. The apparatus of claim 2 in which said insulating structure includes a pair of said openings orthogonally arranged to alternately align with said first bore and said second bore upon rotation of said clamp therein.

4. The apparatus of claims 1 or 3 in which said seizure screw has an enlarged head, said seizing means further including a channel in said insulating structure joining said pair of orthogonal openings therein to permit rotation of said clamp between said openings without removal of said screw.

5. The apparatus of claim 4 in which the opposing ends of said first bore and said pair of orthogonal openings in said insulating structure are tapered to readily permit insertion of a center conductor therein.

6. The apparatus of claims 1 or 2 additionally comprising means for electrically connecting said seizure clamp with electrical circuitry means to transmit the signal carried by a center conductor seized with said clamp.

7. The apparatus of claim 6 in which said electrically connecting means includes:

(a) an axial bore in one end of said clamp; and
(b) a conductive, spiral spring contact received within said bore for contact with said electrical circuitry means.

8. A seizure apparatus for mechanical and electrical connection to the center conductor of a coaxial cable comprising:

(a) a rod-like, conductive seizure clamp, said clamp including:
  (1) a first radial bore therein;
  (2) a second radial bore tapped and intersecting said first bore, said second bore terminates upon intersection with said first bore thereby providing a blind, nonshear stop for seizure of a center conductor;
  (3) a threaded seizure screw mating with said second bore to secure the center conductor of a coaxial cable inserted in said first bore;
(b) a supportive, insulating structure with said clamp rotatably held therein, said structure including a plurality of openings to said clamp; and
(c) means for alternately seizing with said clamp center conductors of differing orientation to said structure by rotating said clamp therein and without disassembly thereof.

9. The apparatus of claim 8 in which said first bore extends through said clamp, said second bore being orthogonal thereto, said seizure screw being of a length too short to contact the opposing wall of said first bore.

10. The apparatus of claim 8 in which said seizing means includes a channel in said insulating structure joining said openings therein.

11. The apparatus of claim 10 in which said seizing means includes means for rotating said clamp to align with different ones of said openings in said structure and without removal of said seizure screw from said clamp.

12. A seizure apparatus for mechanical and electrical connection to the center conductor of a coaxial cable comprising:

(a) a rod-like, conductive seizure clamp, said clamp including:
  (1) a first radial bore therein;
  (2) a second radial bore tapped and intersecting said first bore, said second bore terminates upon intersection with said first bore thereby providing a blind, nonshear stop for seizure of a center conductor;
  (3) a threaded seizure screw mating with said second bore to secure the center conductor of a coaxial cable inserted in said first bore;
(b) a supportive, insulating structure with said clamp rotatably held therein, said structure including a plurality of openings to said clamp; and (c) means for alternately seizing with said clamp center conductors of differing orientation to said structure by rotating said clamp therein and without disassembly thereof; and (d) means for electrically connecting said seizure clamp with electrical circuitry means to transmit the signal carried by a center conductor seized with said clamp, said electrically connecting means including:

(1) an axial bore in one of end of said clamp; and (2) a conductive, spiral spring contact received within said bore for contact with said electrical circuitry means.

13. The apparatus of claim 12 in which said axial bore extends through said clamp and intersects said first and said second radial bores therein, said insulating structure including an opening aligned to expose the end of said axial bore containing said spiral contact therein.

14. The apparatus of claim 13 in which a portion of said axial bore adjacent the aligned opening in said insulating structure is enlarged to receive said spiral contact, said seizure screw being of a length too short to contact the opposing wall of said first bore.

15. The apparatus of claim 14 in which said insulating structure includes a pair of said openings orthogonally arranged to alternately align with said first bore and said second bore upon rotation of said clamp therein.

16. The apparatus of claim 15 in which said seizure screw has an enlarged head, said seizing means further including a channel in said insulating structure joining said pair of orthogonal openings therein to permit rotation of said clamp between said pair of openings without removal of said screw.

17. The apparatus of claim 16 in which the opposing ends of said first bore and said pair of orthogonal openings in said insulating structure are tapered to readily permit insertion of a center conductor therein.

18. The apparatus of claim 17 in which the end portion of said clamp receiving said spiral contact has a reduced outer diameter mating with a correspondingly sized recess in said insulating structure.

19. The apparatus of claim 17 in which said seizure clamp is tin-plated brass, said spiral contact is tin-plated beryllium copper, and said insulating structure is polystyrene plastic.

20. A cable system subscriber tap comprising:

(a) a conductive housing;

(b) a base cover;

(c) fastening means for detachably securing said base cover to said housing to define an inner chamber therein;

(d) a pair of coaxial cable access ports orthogonally arranged in one corner of said housing and accessible to said inner chamber;

(e) seizing means in said chamber, including a conductive, rod-like seizure clamp, for alternately connecting to the center conductor of a coaxial cable inserted through either one of said pair of access ports, said means including means for orthogonally rotating said clamp without disassembly of said seizing means to alternately align with said pair of access ports;

(f) means for alternately attaching the prepared end of a coaxial cable to said pair of access ports to effect an electrical contact between said housing and the outer conductor of the cable with the bared center conductor extending through said access port for seizure by said seizing means and said clamp; and (g) means for electrically connecting said seizing means and said clamp to electrical circuitry means in said housing for transmitting the signal carried by the seized center conductor to a local subscriber.

21. The subscriber tap of claim 20 additionally comprising retaining means in said housing for holding said seizing means and said clamp adjacent said pair of access ports.

22. The subscriber tap of claim 20 in which said seizure clamp includes:

(a) a first untapped radial bore therein;

(b) a second radial bore tapped and orthogonally arranged to and intersecting with said first bore; and (c) a threaded seizure screw mating with said second bore to secure the center conductor of a coaxial cable inserted in said first bore.

23. The subscriber tap of claim 22 in which said seizing means further includes a supportive, insulating structure with said clamp rotatably held therein, said structure including a plurality of openings to said clamp.

24. The subscriber tap of claim 23 in which said insulating structure includes a pair of said openings orthogonally arranged to alternately align with said first bore and said second bore upon rotation of the clamp therein.

25. The subscriber tap of claim 22 or 24 in which said seizure screw has an enlarged head, said seizing means further including a channel in said insulating structure joining said pair of orthogonal openings therein to permit rotation of said clamp between said openings without removal of said screw.

26. The subscriber tap of claim 25 in which the opposing ends of said first bore and said pair of orthogonal openings in said insulating structure are tapered to readily permit insertion of a center conductor therein.

27. The subscriber tap of claim 25 in which said second bore terminates upon intersection with said first bore thereby providing a blind, nonshear stop for seizure of a center conductor, said seizure screw being of a length too short to contact the opposing wall of said first bore.

28. The subscriber tap of claim 20 or 24 in which said means for electrically connecting includes:

(a) an axial bore in one end of said clamp; and (b) a conductive, spiral spring contact received within said bore for contact with said electrical circuitry means in said housing.

29. The subscriber tap of claim 28 in which said first bore extends through said clamp, said second bore terminating upon intersection with said first bore thereby providing a blind, nonshear stop for seizure of a center conductor, said seizure screw being of a length too short to contact the opposing wall of said first bore.

30. The subscriber tap of claim 29 in which said axial bore extends through said clamp and intersects said first and said second radial bores therein, said insulating structure including an opening aligned to expose the end of said axial bore with said spriral contact therein.

31. The subscriber tap of claim 30 in which a portion of said axial bore adjacent the aligned opening in said insulating structure is enlarged to receive said spiral contact.

32. The subscriber tap of claim 31 in which said means for alternately attaching includes a pair of said access ports having internal threading for alternate contact with connecting means on a coaxial cable.

33. The subscriber tap of claim 31 in which said electrical circuitry means includes a printed circuit board secured by fastening means to said base cover and including a conductive contact pin received within said axial bore in said clamp and contacting said spiral contact therein.

34. The subscriber tap of claim 31 in which said fastening means includes means for sealing the inner chamber in said housing from the weather elements.

35. The subscriber tap of claim 31 in which said housing further includes a bracket structure for mounting to a cable.

36. The subscriber tap of claim 31 additionally comprising a second pair of coaxial cable access ports orthogonally arranged in a second corner of said housing and accessible to the inner chamber therein, the subscriber tap further including a second seizing means, means for alternately attaching, and means for electrically connecting associated with said second pair of access ports.

37. A method for alternately connecting to the center conductors of coaxial cables of differing orientaion to a seizure apparatus, comprising the steps of:

(a) rotating a rod-like, conductive seizure clamp held within a supportive, insulating structure to align a first radial bore in the clamp with different ones of a plurality of openings of differing orientation in the insulating structure;

(b) inserting the center conductor through the aligned opening and in the first bore in the seizure clamp; and (c) tightening a seizure screw threaded within a tapped second radial bore intersecting the first bore in the clamp to seize the center conductor inserted therein, said rotating being without disassembly of the clamp or insulating structure or removal of the screw therefrom.

38. A method for alternately connecting to the center conductor of a coaxial cable inserted through one of a pair of coaxial cable access ports orthogonally arranged in a corner of a conductive housing, comprising the steps of;

(a) rotating a rod-like, conductive seizure clamp within its supportive, insulating structure positioned adjacent the pair of orthogonal access ports to align a first radial bore in the clamp with one of the pair of access ports having a coaxial cable inserted therethrough;

(b) inserting the center conductor of the coaxial cable through a corresponding opening in the insulating structure and into the first radial bore;

(c) tightening a seizure screw threaded within a tapped second radial bore intersecting said first bore in the clamp to seize the center conductor therein, said tightening being through the unused access port, said rotating between the pair of access ports being without disassembly of the clamp or insulating structure or removal of the seizure screw therefrom.

39. A method for changing the installation of a cable system subscriber tap to alternately connect to the center conductor of a coaxial cable extending through the unused one of a pair of cable access ports orthogonally arranged in one corner of a conductive housing, comprising the steps of:

(a) releasing the seized center conductor from a first radial bore in a rod-like, conductive seizure clamp held within a supportive, insulating structure mounted adjacent the orthogonal pair of access ports, said releasing being by unscrewing a seizure screw threaded within a tapped second radial bore orthogonally arranged to and intersecting with the first bore in the clamp, said unscrewing being by access through the unused access port;

(b) removing the released center conductor from the first radial bore in the seizure clamp;

(c) rotating the clamp through a 90° angle within its insulating structure to align the opposite end of the first bore with the unused access port, said rotating being to align the seizure screw and second bore with the used access port, said rotating further being without disassembly of the clamp or insulating structure or removal of the seizure screw therefrom;

(d) inserting the center conductor through the desired access port and into the first bore in the seizure clamp; and (e) tightening the seizure screw to seize the center conductor within the first bore, said tightening being by access through the now unused access port.

40. The method of claim 39 in which said releasing, said rotating, said removing, said inserting, and said tightening are accomplished while maintaining an electrical connection between the seizure clamp and printed circuitry means for transmitting the signal carried by the seized center conductor to a local subscriber.

41. The method of claim 40 in which said maintaining is accomplished by means of a conductive, spiral spring contact held within an axial counterbore in the clamp and rotatably contacting a contact pin electrically connected to a printed circuit board.

42. A seizure apparatus for mechanical and electrical connection to the center conductor of a coaxial cable comprising:

(a) a rod-like, conductive seizure clamp, said clamp including:

(1) a first radial bore extending through said clamp;

(2) a second radial bore tapped and intersecting said first bore orthogonal thereto, said second bore terminates upon intersection with said first bore thereby providing a blind, nonshear stop for seizure of a center conductor;

(3) a threaded seizure screw mating with said second bore to secure the center conductor of a coaxial cable inserted in said first bore;

(b) a supportive, insulating structure with said clamp rotatably held therein, said structure including a plurality of openings to said clamp;

(c) means for alternately seizing with said clamp center conductors of differing orientation to said structure by rotating said clamp to align with different ones of said openings in said structure and without disassembly thereof or removal of said seizure screw from said clamp; and (d) means for electrically connecting said seizure clamp with electrical circuitry means to transmit the signal carried by a center conductor seized with said clamp, said electrically connecting means including:

(1) an axial bore in one of end of said clamp; and (2) a conductive, spiral spring contact received within said bore for contact with said electrical circuitry means.

43. The apparatus of claim 42 in which said seizing means includes a channel in said insulating structure joining said pair of orthogonal openings therein to permit rotation of said clamp to align said first bore between said pair of openings without removal of said screw therefrom.

* * * * *